United States Patent [19]

Brumlik

[11] 4,198,734

[45] Apr. 22, 1980

[54] SELF-GRIPPING DEVICES WITH FLEXIBLE SELF-GRIPPING MEANS AND METHOD

[76] Inventor: George C. Brumlik, 134 Upper Mountain Ave., Montclair, N.J. 07042

[21] Appl. No.: 874,300

[22] Filed: Jan. 31, 1978

Related U.S. Application Data

[63] Continuation of Ser. No. 727,491, Sep. 28, 1976, abandoned, which is a continuation of Ser. No. 525,906, Nov. 21, 1974, abandoned, which is a continuation of Ser. No. 387,976, Aug. 13, 1973, abandoned, which is a continuation of Ser. No. 240,958, Apr. 4, 1972, abandoned.

[51] Int. Cl.[2] ..... A44B 17/00

[52] U.S. Cl. ..... 24/204

[58] Field of Search ..... 24/204

[56] References Cited

U.S. PATENT DOCUMENTS

| | | | |
|---|---|---|---|
| 3,123,077 | 3/1964 | Alcamo | 24/204 |
| 3,136,026 | 6/1964 | De Mestral | 24/204 |
| 3,166,072 | 1/1965 | Sullivan | 24/204 |
| 3,490,107 | 1/1970 | Brumlik | 24/204 |
| 3,494,006 | 2/1970 | Brumlik | 24/204 |
| 3,522,637 | 8/1970 | Brumlik | 24/204 |
| 3,708,833 | 1/1973 | Ribich | 24/204 |
| 3,762,000 | 10/1973 | Menzin | 24/204 |

*Primary Examiner*—J. Franklin Foss

*Attorney, Agent, or Firm*—Sprung, Felfe, Horn, Lynch & Kramer

[57] ABSTRACT

Self-gripping devices having a base with a plurality of the gripping element attached are disclosed. The gripping elements are capable of releasably self-gripping fibrous materials without damaging same include a stiffly rigid stem with at least one flexible self-gripping means attached thereto. The self-gripping means can be one or more retaining nibs integral with or attached to the stem and are generally inclined downward so as to offer relatively little resistance upon penetration into a fibrous material and greater resistance to pulling out.

11 Claims, 41 Drawing Figures

SELF-GRIPPING DEVICES WITH FLEXIBLE SELF-GRIPPING MEANS AND METHOD

This is a continuation of application Ser. No. 727,491, now abandoned, filed Sept. 28, 1976, which, in turn, is a continuation of application Ser. No. 525,906, filed Nov. 21, 1974, now abandoned, which, in turn, is a continuation of application Ser. No. 387,976, filed Aug. 13, 1973, now abandoned, which in turn is a continuation of application Ser. No. 240,958, filed Apr. 4, 1972, now abandoned.

BACKGROUND

This invention relates to self-gripping devices containing dynamic self-gripping elements which are capable of entering into reversible self-gripping engagement with fibrous or porous receiving materials and which offer a great degree of protection from damage upon forming and dissociating the self-gripping junction.

This invention also relates to gripping elements having unique self-gripping means.

Self-gripping devices have been known for some time but only recently have they begun to replace conventional fastening devices such as staples, snaps, nails, adhesives and the like. In general, self-gripping devices perform many unique functions which conventional fasteners cannot provide. For instance, there is unlimited freedom of self-gripping engagement over an area by virtue of the vast number of gripping sites in a receiving material. This has the effect of eliminating alignment criticalities that seriously hamper conventional fasteners, involving mating specific fastening sites such as a bore or hole with corresponding fastening devices such as a screw, bolt, snap or rivet or the two halves of a zipper.

A reversible or permanent self-gripping connection can be formed simply by hand without the need for special tools. Once a reversible self-gripping connection is formed it can be pulled apart due to the releasable nature of the self-gripping connections. This may provide for invisible attachment that leaves no visible marks once the connection is pulled apart and established elsewhere on the surface. This is especially true for carpet covered walls and ceilings which are finding increased use as an interior surface finish.

Also, a plurality of gripping elements in a self-gripping device cooperate to provide the required amount of self-gripping holding force and distribute same over a predetermined area thus avoiding localized stress concentrations such as occurs with conventional fasteners.

Another desirable feature is that the gripping elements of a device may be inherently flexible which allows a self-gripping connection to accommodate dimensional changes caused by large thermal coefficients of expansion that occur between similar or dissimilar articles connected to each other by a self-gripping mechanism. This prevents buckling and cracking of joined articles.

One more capability of self-gripping devices is the ability to form a self-gripping connection between articles on any face, edge or corner by simply bringing any pair of these into contact at the desired location.

With the increasing use and advancing sophistication of self-gripping devices certain advantages and capabilities for special and unique applications become important. For example, in many instances it is desirable to form a self-gripping connection with a receiving material and especially fibrous receiving materials, without damaging or harming the receiving material. This becomes even more critical where it is desirable to form a reversible or releasable self-gripping engagement without causing any damage or leaving marks upon detaching the articles at the site of the formed self-gripping connection.

SUMMARY

The present invention provides self-gripping devices containing a plurality of self-gripping elements which are capable of entering into reversible self-gripping engagement with receiving materials that are fibrous, cellular or porous in nature without damaging or harming the receiving material upon forming or breaking the self-gripping connection.

The self-gripping devices of the invention comprise a base having attached thereto a plurality of gripping elements having a stiffly rigid stem having attached thereto at least one separate or integral flexible self-gripping means. The self-gripping means can be retaining nibs, for example, and are preferably downwardly biased so as to offer relatively little resistance to penetration into a receiving material and greater resistance to pulling out.

The self-gripping elements are stiffly attached in an upright position to a base which can be a surface, a line or a point. The rigid stem of the dynamic gripping elements makes it possible for a device to penetrate densely into a receiving material and especially receiving materials formed from woven, nonwoven or knitted fabrics, felts, paper, foam, leather, feathers, hair, mesh, and the like, and other such materials which may be fragile or frail or which have surfaces which are not to be impaired.

DESCRIPTION

Figure 1:
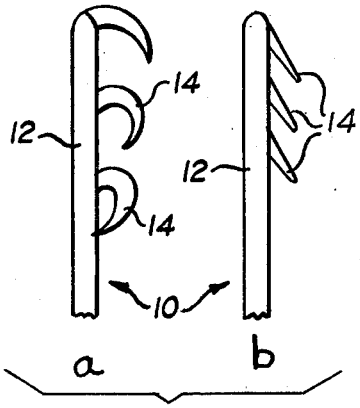
FIGS. 1*a* and *b* are side elevational views showing two embodiments of the dynamic gripping elements of the invention.

Referring now to the drawing and in particular to FIG. 1, the self-gripping elements are identified by the reference numeral 10 and are shown to include a stiffly rigid stem having attached thereto a plurality of flexible self-gripping means 14.

The self-gripping means can be integral with or separate from the base and can be flexible per se or stiff or rigid and flexibly attached to the stem. Thus, the term flexible is used herein to indicate that the self-gripping means are capable of flexing or bending towards the base upon penetration of the gripping elements into a receiving material and are further capable of bending or flexing away from the base upon disconnecting the devices of the invention from a self-gripping engagement with a receiving material.

The phrase "stiffly rigid" as applied to the stem of the gripping elements is intended to describe materials which are sufficiently strong and tough to prevent breaking or cracking upon encountering forces involved in self-gripping such as upon penetration into a receiving material and includes materials described in greater detail herein which can bend or flex without breaking and return to their original position.

In FIG. 1*a* the self-gripping means comprise a series of retaining nips or hooks which progressively increase in curvature providing for increasing self-gripping force as the gripping elements penetrate a receiving material. It is thus possible to form a self-gripping connection utilizing 1, 2 or all of the gripping means 14.

In FIG. 1*b* the self-gripping means are shown as retaining nibs 14 which are downwardly inclined. It is preferred that the retaining nibs forming the self-gripping means be inclined downwardly so as to offer relatively little or slight resistance to penetration into a receiving material but greater resistance to pulling out as is described in greater detail herein.

Figure 2:
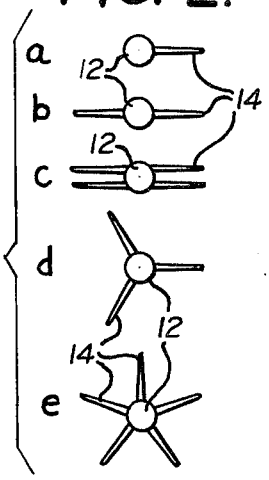
FIGS. 2*a* through *e* are horizontal sectional views showing the positioning of flexible self-gripping means about the periphery of the stem.
Figure 4:
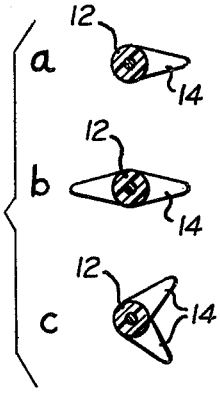
FIGS. 4*a* through *c* are further horizontal sectional views illustrating additional shapes and positions for the flexible self-gripping means.

FIGS. 2 and 4 provide several illustrations regarding the relationship between the size of the self-gripping means 14 as compared to the stem 12 and their positions on the stem 12. For example, a single retaining nib or a vertical row of nibs can extend from a shaft in the same plane as shown in FIGS. 2*a* and 4*a*. It is also possible to have one or more retaining nibs 14 extending or rotating about various planes from the shaft 12 as is illustrated in FIGS. 2*a* through *e* and 4*b* through *c*.

The self-gripping elements of the present invention can be integral by being formed (e.g. by molding, extruding, etc.) from the same material and tailoring the relative dimensions such that the stem 12 is rigid and the gripping means 14 are flexible. Because the gripping means 14 as shown in FIG. 2 are much thinner than the stem, they are flexible as compared to the more rigid stem 12. The ratio of stem to gripping means thickness depends on the physical properties of the material being used such as hardness, stiffness, modulus of elasticity, etc.

The gripping elements may also be composite wherein the gripping means 14 are physically attached to the shaft 12 as is illustrated for example in FIG. 4.

Figure 3:
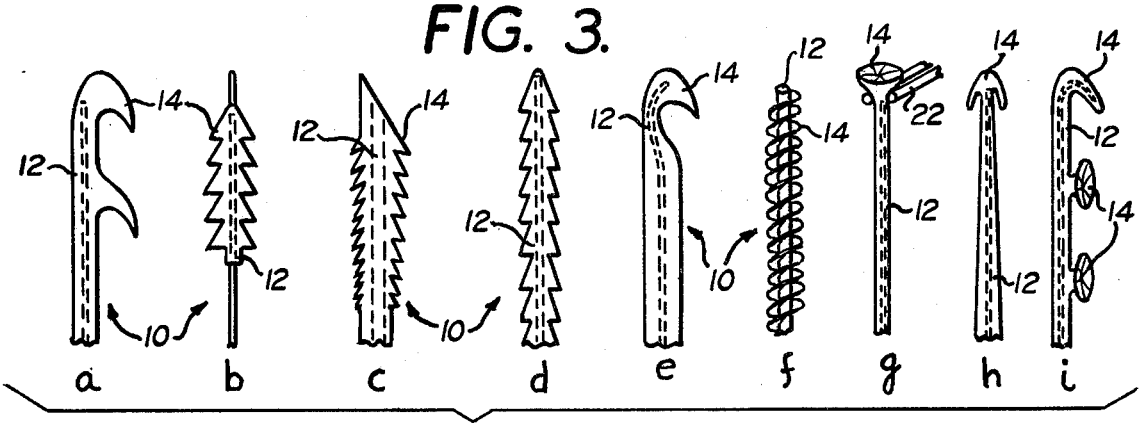
FIGS. 3*a* through *i* are side elevational views showing several embodiments of composite dynamic gripping elements of the invention.

Additional composite gripping elements are shown in FIG. 3 wherein stem 12 is sheathed in the material forming the self-gripping means 14. In FIGS. 3*a, c d* and *e*, the material forming the self-gripping means 14 completely sheaths the stem 12 and forms a variety of hooks and barbs on one or both sides of the gripping element 10. In FIG. 3*b* the upper and lower ends of the stem 12 protrudes from the material forming the self-gripping means 14. This embodiment is desirable in aiding initial penetration into a receiving material. In FIG. 3*f* the gripping means 14 form a helical twisted about the stem 12 which can be smooth as shown or notched to provide additional self-gripping ability.

FIGS. 3*g, h* and *i* illustrate a unique gripping element capable of functioning in two ways. These gripping elements include a stem 12 and are sheathed in a material which forms the self-gripping means 14 which in this instance has a suction cup located at the upper end of the element. Note that the suction cup is capable of functioning in the normal way and is also capable of engaging filaments 22 as shown. In addition, as shown in FIG. 3*a* the suction cup 14 can be bent over to form a mushroom shaped cap which provides dual acting self-gripping means. In FIG. 3*i* the self-gripping suction cups are located along the stem 12 and the gripping element terminates in a hook member similar to that shown in FIG. 3*a*. The suction cup gripping means can be molded or formed in place or separately attached or they can be initially formed as a bubble on the stem 12 which is made to burst to form the suction cups.

In addition to the embodiments shown in FIG. 3 it is possible to provide self-gripping means on stem by using a highly frictional or even tacky material which can surround all or part of the stem. Such materials include natural and synthetic rubbers, which are capable of engaging a receiving material and gripping same by virtue of their particular surface properties.

Figure 5:
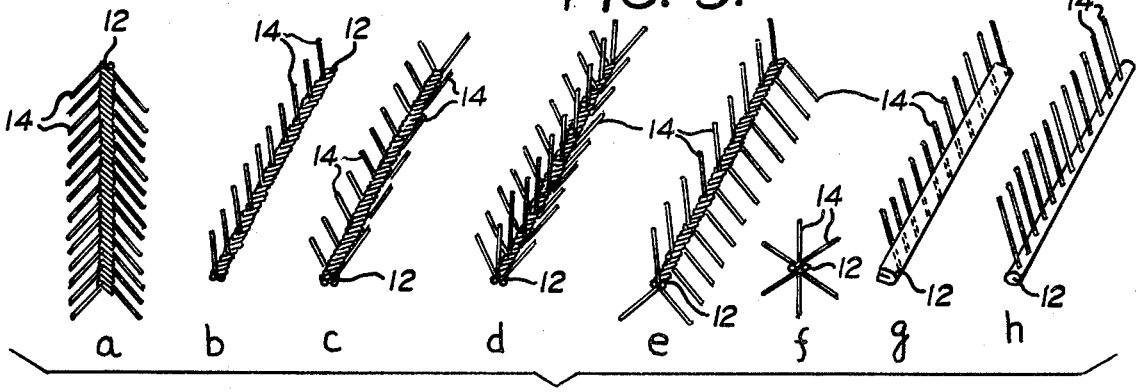
FIGS. 5*a* through *h* are perspective views illustrating alternate embodiments of composite gripping elements wherein the stem is twisted or folded to mechanically interlock with fiber or made like flexible gripping means.

FIG. 5 illustrates several embodiments wherein the stem 12 is twisted or folded along its vertical axis. The flexible self-gripping means in the form of flexible fibers, wires or bristles 14 are interlocked among the twists or folds of the stem 12 in one or more rows which can radiate from the stem 12 in any number of directions as illustrated. In FIG. 5*h* the bristle like members 14 are shown physically attached to a cylindrical stem 12.

The stems 12 shown in the several embodiments illustrated in FIG. 5 can be made of a yarn which can be made rigid by fusion, bonding or by applying a surface finishing such as varnish, etc. The self-gripping means can also be bonded or fused to a rigid thin rod-like stem as shown for example in FIG. 5*h*.

Figure 6:
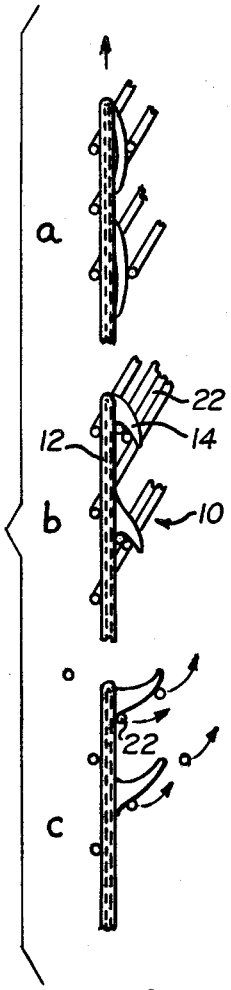
FIGS. 6, 7 and 8 are perspective views each showing three stages of self-gripping engagement of various gripping elements of the invention with a fibrous receiving material.

Referring now to FIGS. 6, the mechanism of establishing and disengaging a self-gripping connection utilizing the gripping elements is illustrated. In FIG. 6*a* the gripping element 10 passes through and between fibers 22 which represent fibers or filaments in a receiving material. As the gripping element 10 passes between fibers 22, the retaining nibs 14 flex downward and tend to lay flat along the stem 12 as shown in FIG. 6*a*. FIG. 6*b* shows the gripping element 10 lodged in a receiving material in self-gripping engagement with fibers 22.

FIG. 6c shows a reverse force being applied to the gripping element and the retaining nibs 14 flex downwardly along the fibers 22 to escape as illustrated by the arrows thus causing little or no damage to the fibers 22.

Figure 7:
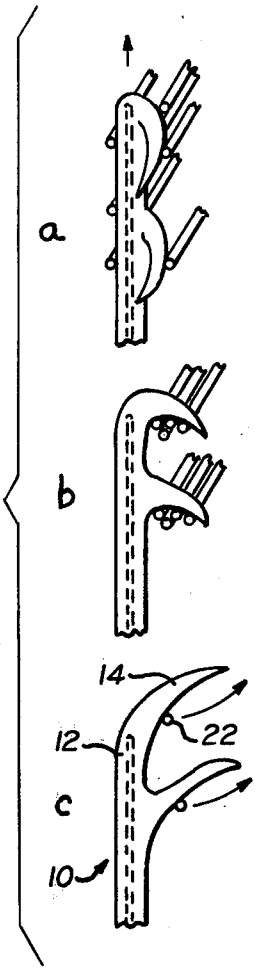
Figure 8:
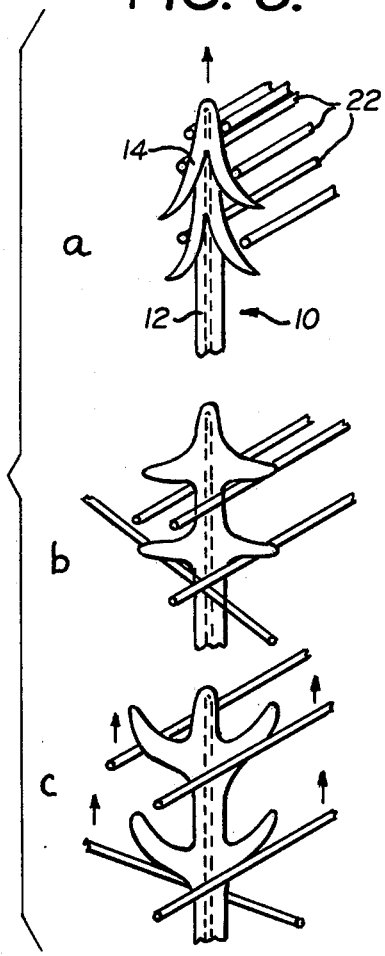

FIGS. 7 and 8 illustrate the mechanism described for FIG. 6 with respect to additional configurations of the gripping element of the invention. Note particularly in FIG. 7b that the retaining nibs 14 are capable of self-gripping bundles of fibers 22. Also in FIG. 8a the fibers 22 are spread apart, upon penetration of the gripping elements and once they pass over the retaining nibs 14 their relationship in the receiving material tends to bring them together again as shown in FIG. 8b, thus permitting the formation of a self-gripping connection.

The stem 12 must be sufficiently stiffly rigid to avoid deflection which would otherwise prevent the gripping element from penetrating and becoming lodged in a receiving material. The stem can be suitably formed from metals, plastics or glass or composites of the foregoing such as metal wire sheathed in glass or plastic, or plastic reinforced with glass fiber and the like. Suitable metals include iron, steel aluminum, copper, brass, alloys thereof, and the like. Plastics include both thermosetting and thermoplastic materials such as nylons, propropylene polyesters, polyamides, polyacetals, polysulfones, polycarbonates, polyvinyl chlorides, polyethers, halogenated polymers, phenolic and melamine resins and the like. The stem 12 can have any desired cross-sectional shape such as round, oval, flat and the like.

The self-gripping means can be in the form of hooks, barbs, teeth, a ratchet sequence of teeth and should be capable of flexing or bending towards the stem and in the direction of the base when the stem carries them into a penetrable, preferably fibrous receiving material. The above mentioned gripping means bend out when the gripping element is lodged in the receiving layer and are distorted in the direction away from the base when they are pulled out of a receiving material. By forming the gripping means from supple or soft materials damage to the receiving material is minimized or eliminated both during penetration and pulling out of the gripping elements. The degree of flexibility resiliency and/or softness of the self-gripping means can be widely varied and controlled to obtain any degree of self-gripping force desired with any chosen configuration for the gripping element. It is also possible to vary the surface properties of the self-gripping means from smooth and slippery up to highly frictional, gritty, or tacky.

Thus, the self-gripping means can be formed integrally with the stem in such a way that the stem is robust and stiffly rigid and the self-gripping means thin and flexible. The self-gripping means can also be a composite part of the gripping element attached to the stem using any joining techniques such as welding, heat sealing, bonding, gluing and the like. The self-gripping means thus can be formed from any of the materials previously described for the shaft when forming integral gripping elements and in addition when forming composite gripping elements the self-gripping means can be formed from a natural or synthetic rubber material or elastomer such as polyolefins, ethylene, vinyl acetate copolymers, plastisoles, ionomers, silicon resins, polyesters, polycarbonates, polyurethanes and polysulfides, polyacrylates and the like including rubbers and elastomers which have or can be imparted varying surface properties such as smooth, slippery, high friction, coarse, gritty and even tacky.

Figure 12:
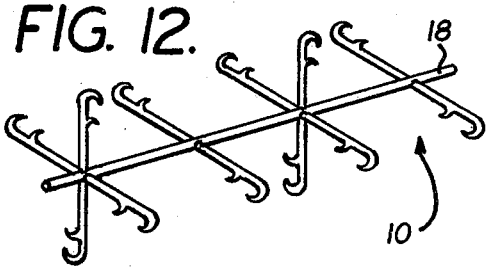
FIGS. 12 and 13 are perspective views illustrating further embodiments of the self-gripping device of the invention.
Figure 13:
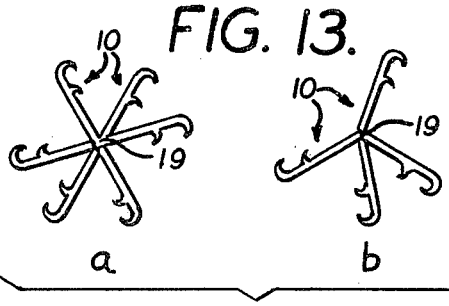
Figure 9:
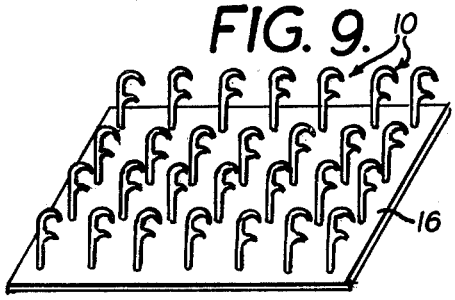
FIGS. 9, 10 and 11 are perspective views illustrating various self-gripping devices of the invention which incorporate the dynamic gripping elements.
Figure 10:
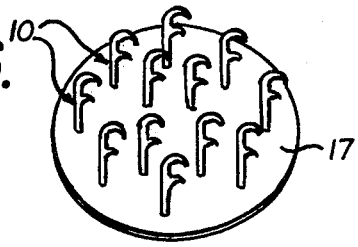
Figure 11:
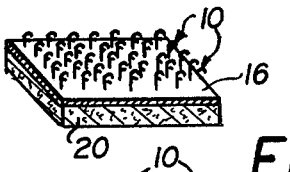

Referring now to FIGS. 9–13, the self-gripping device of the invention is shown to include a plurality of upright gripping elements 10 stiffly attached in thick profusion or in relatively close proximity to each other to a base such as a sheet or tape 16 shown in FIGS. 9 and 11, the disc-like patch 17 shown in FIG. 10, or a linear element such as the filament 18 shown in FIG. 12 or a common point 19 as shown in FIGS. 13a and 13b. Similar or dissimilar gripping elements 10 which can vary in size relative to each other may be arranged on a base in an irregular or uniform pattern and they may also extend from both sides of a base or they may radiate about a line or linear element 18 as shown in FIG. 12 or about a common point such as the six element symmetrically arrangement shown in FIG. 13a or the four element tetrahedron arrangement shown in FIG. 13b. The elements 10 attached to linear member 18 may be at a 90° angle or inclined at a greater or lesser angle. The linear devices shown in FIG. 12 may also be a part of a woven or non-woven structure such as a fabric to constitute a self-gripping device of the invention.

The term generally upright is intended to include gripping elements inclined at an angle to the base forexample from about 25° up to 90°. In some instances, it is preferred to incline the entire gripping element at an angle relative to the base to promote self-gripping action or for particular applications for example where the self-gripping device is mounted on a vertical surface. It should also be noted that a plurality of gripping elements 10 such as shown in FIG. 9 for example, cooperate in gripping a receiving material and effectively distribute the force over a given area thus eliminating concentrations of stress. Combinations of gripping elements which vary in shape and/or size may also be utilized in the same device.

Generally speaking, the upper ends of the gripping elements 10 can be characterized as having a penetrating profile or shape to facilitate penetration into a receiving material. This may be accomplished by any of the shapes illustrated in FIGS. 1, 3 and 5. In addition, flat stems can be cut at an angle or pointed, rounded or otherwise shaped. In those instances, where skin irritation is to be avoided, the upper end of the gripping elements 10 are preferably rounded.

As indicated above the self-gripping elements of the device of the invention are adapted to penetrate and become lodged in a receiving material and be removed therefrom without damaging or harming the material. The device of the invention is especially useful with receiving materials which comprises fibers, yarns, fibrils, filaments or thin walled cells, webs or sheets.

Thus, the self-gripping device of the invention is particularly adapted for self-gripping and release of a wide variety of materials without harming them such as woven, non-woven and knitted fabrics, fibers and fiber aggregates, carpets, carpet-like materials, foamed rubber and plastics, felt, wood, cork, sponge, animal and artificial fur and hair, feathers, leather, paper, cardboard, corrugated cardboard, metal and plastic mesh, filter sheets, expanded and perforated sheet materials and composites of any of the foregoing.

The receiving material may also be a thin wall or laminae which is capable of being penetrated or pierced by the gripping element such as a sheet per se or an interior cellular wall; also included are web-like structures having thinned out or localized areas capable of being self-gripped. For example, such sheets can be a sheet with densely punched holes relatively close to each other or expanded sheets such as expanded metal. Especially suitable receiving materials and structures are disclosed in my U.S. Pat. Nos. 3,863,304, issued Feb. 4, 1975, and 3,913,183, issued Oct. 21, 1975.

Figure 14:
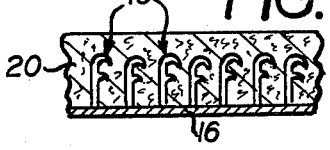
FIG. 14 is a side sectional view illustrating further embodiments of the invention where a protective layer of hybrid gripping surface is utilized with the device of the invention.

Referring now to FIG. 14, a self-gripping device of the invention comprising a sheet 16 and upright gripping elements 10 is shown in self-gripping engagement with a receiving layer 20 which is shown to be fibrous in nature for purposes of illustration.

In certain applications, it is desirable to utilize a receiving layer such as that shown in FIG. 14 as a protective layer for the gripping elements 10 which can be stripped off to prepare the device for self-gripping engagement. The use of a protective layer makes it possible to ship and handle the gripping device of the invention without irritation to the user or premature self-gripping engagement. The protective layer may have a thickness equal to or shorter or greater than the height of the gripping elements 10. Such a protective layer can be readily utilized with any of the various embodiments of the invention such as those shown in FIGS. 9 through 13 for example.

It is also possible to use the receiving layer 20 as a component part of the device of the invention. In this instance the layer 20 is made of a resilient material such as felt, carpets, carpet-like materials, woven, non-woven and knitted fabrics and fibers, mats made of monofilaments or staple fibers in parallel, braided or random orientation, sponge, plastic and rubber foam and the like, that remains in place over the gripping elements 10 forming what can be called a hybrid self-gripping surface. The gripping elements 10 in this embodiment can extend below to or beyond the surface of layer 20. Thus, when the layer 20 is compressed, the elements 10 are exposed and protrude out of the layer 20 and are then capable of self-gripping engagement with a receiving layer or material or a similar hybrid self-gripping device.

In FIG. 11, a receiving material 20 described above is attached to the back of sheet 16 forming another hybrid type of device that can loop around and self grip itself or be gripped by other devices.

In general, the gripping elements are sufficiently stiff such that they resist deflection which would otherwise prevent them from penetrating and becoming lodged in a receiving layer or material. It is also necessary that the gripping elements be sufficiently stiffly attached to the base to enable the gripping elements to enter into self-gripping engagement. Thus, the gripping elements can be attached to a base by any suitable technique consistent with the nature of the gripping element and the base. The base itself can be fabricated from a wide variety of materials such as metal, wood, rubber, elastomers, natural and synthetic leather, plastics, glass, paper, cardboard, porous, woven and non-woven materials such as fabrics, metal and plastic mesh and the like.

The gripping elements can be attached to the base by inserting the lower ends in a sheet, patch or strip such as shown in FIGS. 9–11 and/or by mechanically attaching the gripping elements using adhesive, hot melt adhesives, tufting (as in brush or carpet manufacturing), electrostatic and other flocking process, fibers laying followed by cutting and bending up, weaving, knitting, pulling out by needle felting, welding or heat sealing techniques. The gripping elements 10 may also be attached to base 16 in a staple-like fashion.

In the embodiment shown in FIG. 12 the gripping element 10 can be attached to the filament 18 which can be made of metal, plastic or glass using the above techniques, twisting between strands of wire as in a brush. The devices of FIG. 12 may also be attached to a backing member in a parallel crosswise fashion to form a self-gripping sheet or web. The same is true in the embodiments shown in FIGS. 13*a* and *b* where a plurality of gripping elements are attached at a common point 19 forming the base of the clustered self-gripping device.

Figure 15:
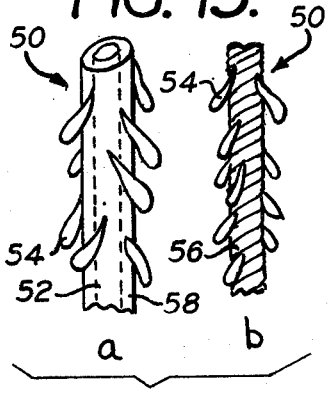
FIGS. 15*a* and *b* are side elevational views showing several embodiments of gripping elements wherein fibrils or scales are physically bonded to a stem.

The gripping elements generally range in length from about 0.002 to about 0.75 inch. It should be noted that extremely small gripping elements can form the device of the invention and yet be invisible to the naked eye. A further embodiment is illustrated in FIG. 15. Self-gripping elements useful in this invention include a stem 52 having physically bonded thereto one or more self-gripping nibs 24 such as fibrils and/or scales. These gripping elements indicated generally by the reference numeral 50 can be conveniently made in a continuous fashion by passing a substantial continuous linear element through a mass of fibrils and/or scales which become physically bonded to the member by reason of the adhesive and coating applied to the linear element before it contacts the mass. As the coated member leaves the mass, it passes through a suitable opening which orients the gripping means in the same direction.

The fibrils or scales 54 can be smaller than, equal to, or larger than the diameter of the stem member 52. The gripping members 54 can be widely spaced or in relatively thick profusion and can be physically bonded to the stem 52 by using an adhesive coating as shown in FIGS. 15*a*, for example, or by using a yarn as shown in FIG. 15*b* wherein the gripping members 54 become interlocked in the twists of the yarn and are secured in place by means of an adhesive by fusing, sealing, etc.

Figure 16:
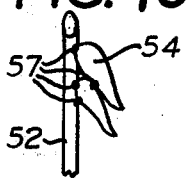
FIG. 16 is a side elevational view illustrating various ways in which self-gripping scales can be physically bonded to a stem and to each other.
Figure 17:
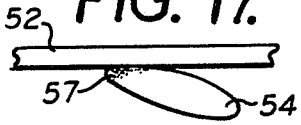
FIG. 17 is a side elevational view illustrating a further way in which a self-gripping scale can be physically bonded to a stem.

It is also possible depending on the nature of the stem 52 to bond the gripping elements 54 by spot adhesion or by direct fusion. Here the elements 54 can be rigid and the bond 57 with stem 52 flexible. FIG. 16 illustrates the use of several scales 54 spot secured at 57 at one or more points on the stem 52 and in overlapping relationship to each other. FIG. 17 illustrates a scale 54 fused to a stem member 52 in the area 57.

Figure 18:
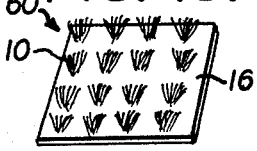
FIG. 18 is a perspective view of a further embodiment wherein gripping elements are combined into gripping tufts on a base.

FIG. 18 illustrates an embodiment wherein tufts 60 formed from clusters of the gripping elements 10 or 50 according to the invention are tufted using conventional well known techniques into or through a base 16. Self-gripping devices comprising tufts and can be made from individual elements such as shown in FIGS. 3, 5 and 15 clustered together to form a tuft which can be inserted into a base. The elements in the tufts can be parallel to each other or they can radiate in a fountain-like manner.

The devices shown in FIGS. 13*a* and *b* and FIG. 12 wherein more than two elements 10 radiate from a common point on member 18 are also considered self-gripping tufts wherein the unique flexible self-gripping means of the invention are employed.

The self-gripping elements and devices of the invention may be used in a variety of ways to efficiently and quickly render virtually any surface or article self-gripping. The device of the invention can be readily used by individuals and commercial users to render selected areas of articles or entire articles self-gripping, such as carpets, fabric, felts, wall cladding materials, panels, tile, sheets, filters, decorative trim, and the like.

What is claimed is:

1. A self-gripping device for engagement with fibrous materials comprising a base sheet and a multitude of bristle-like gripping elements mounted in dense profusion in all directions over the surface of the base sheet, the said gripping elements comprising a stiffly rigid stem of constant cross sections and a plurality of flexible retaining nibs for retaining fibers or fiber bundles of fibrous materials, said nibs arranged one above the other on said rigid stem, each of the said retaining nibs attached in transverse orientation to the said stiffly rigid bristle-like stems and bending towards said base sheet, a plurality of said stems passing into a fibrous sheet and being secured thereto such that the nibs thereof engage said fibrous sheet.

2. Self-gripping device of claim 29 wherein said base sheet comprises a surface and said gripping elements extend from either of the sides of the two surfaces with the base sheet.

3. Self-gripping device of claim 1 in self-gripping engagement with a receiving material.

4. Self-gripping device of claim 3 wherein the receiving material comprises fibers, fibrils, filaments and thin-walled cells, webs and sheets.

5. Self-gripping device of claim 1 wherein said gripping elements extend from one side of said base sheet and a resilient receiving material is attached to the opposite side thereof.

6. Self-gripping device of claim 1 wherein said nib is constructed of a material different from the material of said rigid stem.

7. Self-gripping device of claim 1 wherein said nib is hingedly secured to said stem.

8. Self-gripping device of claim 1 wherein said nib is in engagement with a fibrous material, said gripping device being further characterized in that when inserted into a fibrous mass it offers less resistance to penetration than when the same is pulled out therefrom.

9. Self-gripping device of claim 8 wherein said stiffly rigid stem has a length of about 0.002 to about 0.75 inch.

10. A self-gripping device according to claim 1 wherein there are a plurality of uniform or irregular clusters on said base such that said clusters are mounted in a dense profusion in all directions over the surface of the base sheet, each of said clusters comprising at least one of said stiffly rigid stems of constant cross section containing said flexible retaining nib transversely oriented to said stiffly rigid stem and bending towards said base sheet.

11. Self-gripping device according to claim 10 wherein at least one of said clusters comprises 4 to 6 gripping elements.

* * * * *